US008381662B2

(12) United States Patent
Goldszer

(10) Patent No.: US 8,381,662 B2
(45) Date of Patent: Feb. 26, 2013

(54) FOLDABLE TABLE

(75) Inventor: Jacob Goldszer, Weston, FL (US)

(73) Assignee: JGR Copa, LLC, Hollywood, FL (US)

( * ) Notice: Subject to any disclaimer, the term of this patent is extended or adjusted under 35 U.S.C. 154(b) by 25 days.

(21) Appl. No.: 13/102,922

(22) Filed: May 6, 2011

(65) Prior Publication Data

US 2012/0279429 A1 Nov. 8, 2012

(51) Int. Cl.
*A47B 37/00* (2006.01)

(52) U.S. Cl. ..... 108/50.12; 135/16; 108/25

(58) Field of Classification Search ..... 108/25, 108/26, 50.12; 135/16
See application file for complete search history.

(56) References Cited

U.S. PATENT DOCUMENTS 2,805,109 A * 9/1957 Kopmar ..... 108/25
3,677,571 A 7/1972 Maturo, Jr. et al.
3,693,993 A 9/1972 Mazzarelli et al.
4,055,357 A 10/1977 Sorocin
4,222,585 A 9/1980 Crothers
D265,154 S 6/1982 Cox
4,501,201 A * 2/1985 Fitzner et al. ..... 108/27
4,703,944 A 11/1987 Higson
4,927,024 A 5/1990 Lloyd
5,197,754 A 3/1993 Ward
D335,796 S 5/1993 Barnes
D336,407 S 6/1993 Harding et al.
D343,083 S 1/1994 Heiman
D345,083 S 3/1994 Rosenfield
5,505,645 A * 4/1996 Engler, Jr. ..... 135/16
D378,477 S 3/1997 Sussman
D382,727 S 8/1997 Kresge et al.
5,915,722 A 6/1999 Thrasher et al.
5,918,550 A 7/1999 Weir et al.
5,934,634 A * 8/1999 Lindblom ..... 108/50.12
5,988,671 A 11/1999 Abelbeck et al.
5,996,511 A * 12/1999 Swoger ..... 108/50.12
D423,290 S 4/2000 Green
D435,196 S 12/2000 Gregor et al.
D445,619 S * 7/2001 Achey ..... D6/511
D496,828 S 10/2004 Lackey
6,883,673 B1 * 4/2005 Gourley ..... 108/94
6,889,618 B1 * 5/2005 Gromack ..... 108/50.12
D519,309 S * 4/2006 Terada ..... D6/511
D534,816 S 1/2007 Newton
D551,890 S 10/2007 Gruber
D573,410 S 7/2008 Hou
D591,560 S 5/2009 Lackey et al.
D592,418 S 5/2009 Bergin
D599,972 S 9/2009 Goldszer
D606,774 S 12/2009 Kohli
D630,687 S 1/2011 Meinel
D634,541 S 3/2011 Gutierrez
D642,408 S 8/2011 Pirkl
8,136,458 B1 * 3/2012 Cass et al. ..... 108/50.12
2004/0129184 A1 * 7/2004 Kraker ..... 108/50.12
2005/0039639 A1 2/2005 Espenschied
2007/0246091 A1 * 10/2007 Becker ..... 135/16
2008/0061524 A1 3/2008 Goldszer
2010/0163086 A1 * 7/2010 Chavez et al. ..... 135/16

* cited by examiner

*Primary Examiner* — Jose V Chen
(74) *Attorney, Agent, or Firm* — Knobbe, Martens, Olson & Bear, LLP

(57) ABSTRACT

A foldable table that is supported by a pole includes a first table portion rotatably coupled to a second table portion. The table can be folded by rotating one or both of the table portions about a joint between the table portions. The table includes a recess for receiving the pole when the table is in an unfolded arrangement.

16 Claims, 9 Drawing Sheets

FOLDABLE TABLE

BACKGROUND OF THE DISCLOSURE

1. Field of the Invention

Embodiments of the present invention relate to tables or platforms and, more specifically, to a table supported by a pole or other rigid structure.

2. Description of the Related Art

Umbrellas and tents are often used for outdoor gatherings and for providing shade at the beach. Generally, such umbrellas and canopies include poles and rigid frame structures that extend vertically. At outdoor gatherings it is desirable to have a table surface in the shade of the umbrella or canopy for holding refreshments, food, keys, clothing and other personal items. It is desirable that the table be easy to operate, easy to transport, durable, and storable is small spaces such as a car trunk or bag. Prior art tables are generally large, heavy, and awkward for carrying to and from an outdoor location. Such tables are often expensive and cannot be easily stored in small spaces or vehicles.

SUMMARY OF THE DISCLOSURE

A need exists for a portable table that provides ease of operation and assembly, durability, inexpensive manufacture, storability and easy transportation. In some embodiments, the present foldable table provides many of these desired characteristics.

A preferred embodiment involves a foldable table including a first table portion and a second table portion. The second table portion is rotatably coupled to the first table portion. The foldable table also includes a joint between the first table portion and the second table portion and the first and second table portions are rotatable about the joint. The table includes a first recess adjacent the joint and configured to receive a pole. The first table portion is rotatable with respect to the second table portion so that the table can be folded by rotating the first table portion toward the second table portion.

In some embodiments the foldable table includes a support member configured to engage the first recess and frictionally engage a pole. Preferably, the support member is configured to engage the first and second table portions such that the support member inhibits relative rotational movement between the first and second table portions.

Preferably, the first recess is located between the first table portion and the second table portion, the first recess extending through a portion of the joint. In some embodiments, the first table portion and second table portion are coupled together by a flexible material.

A preferred embodiment of a foldable table includes a first table portion having a first surface that is generally planar and a second table portion having a second surface that is generally planar. The second table portion is rotatably coupled to the first table portion. The table includes a recess configured to receive a pole or rigid structure. Preferably, the first and second table portions have a first position in which the first surface and the second surface face in substantially the same direction. Preferably, the first and second table portions have a second position achieved by rotating at least one of the first and second table portions so that the first surface and the second surface face in opposite directions.

In some embodiments, the first surface and the second surface are substantially parallel and face each other when the first and second table portions are in the second position. Preferably the first surface and the second surface are rotatably coupled by a flexible material.

In some embodiments, the recess extends perpendicular to the first and second surfaces when the first and second table portions are in the first position. In some embodiments, the first table portion and the second table portion are unitary or integral.

BRIEF DESCRIPTION OF THE DRAWINGS

These and other features, aspects and advantages of the present foldable table are described herein with reference to drawings of preferred embodiments, which are provided for the purpose of illustration and not for limitation. The drawings contain eleven (11) figures.

DETAILED DESCRIPTION OF THE PREFERRED EMBODIMENT

Figure 1:
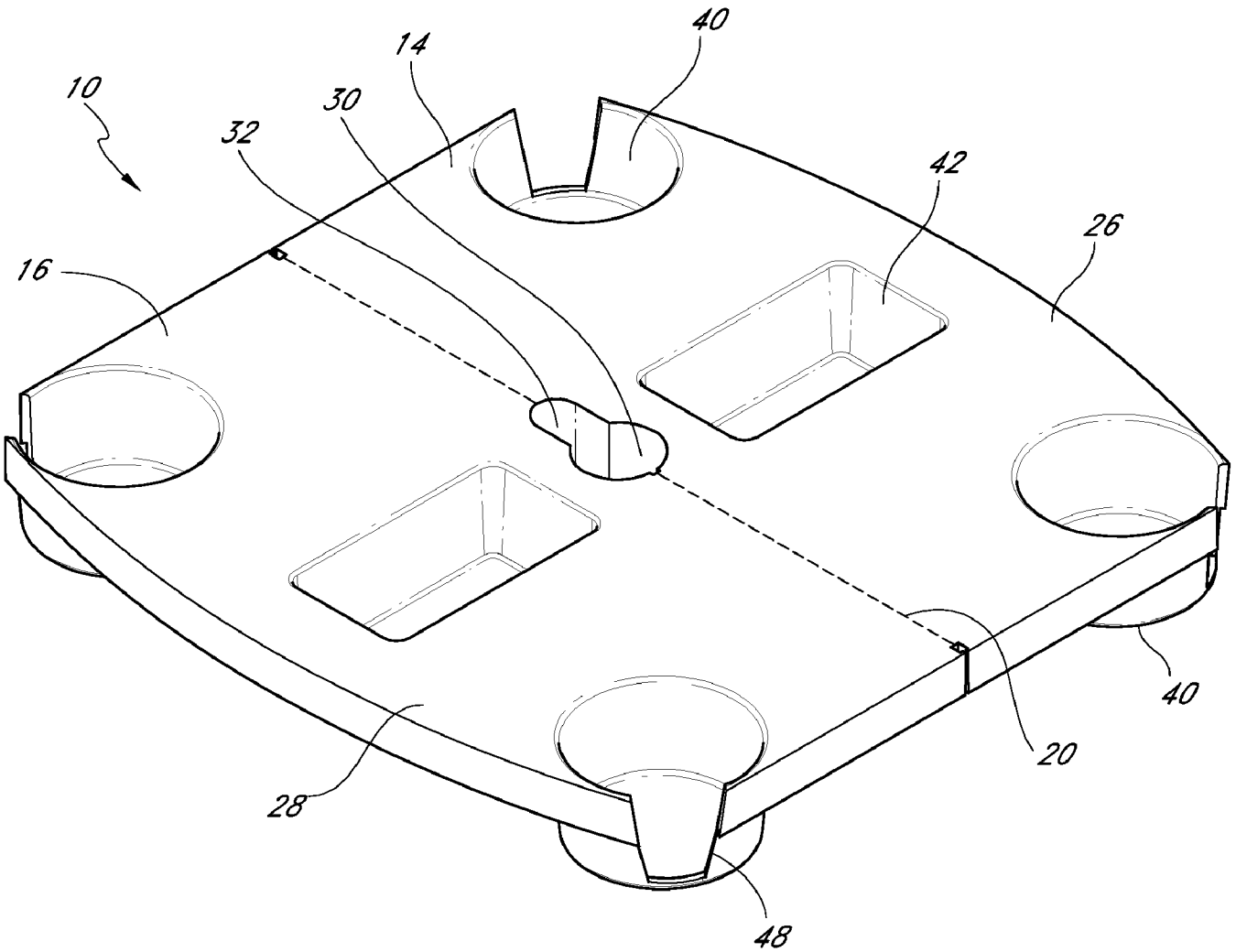
FIG. 1 is a top perspective view of an embodiment of a foldable table having certain features, aspects and advantages of the present invention.
Figure 2:
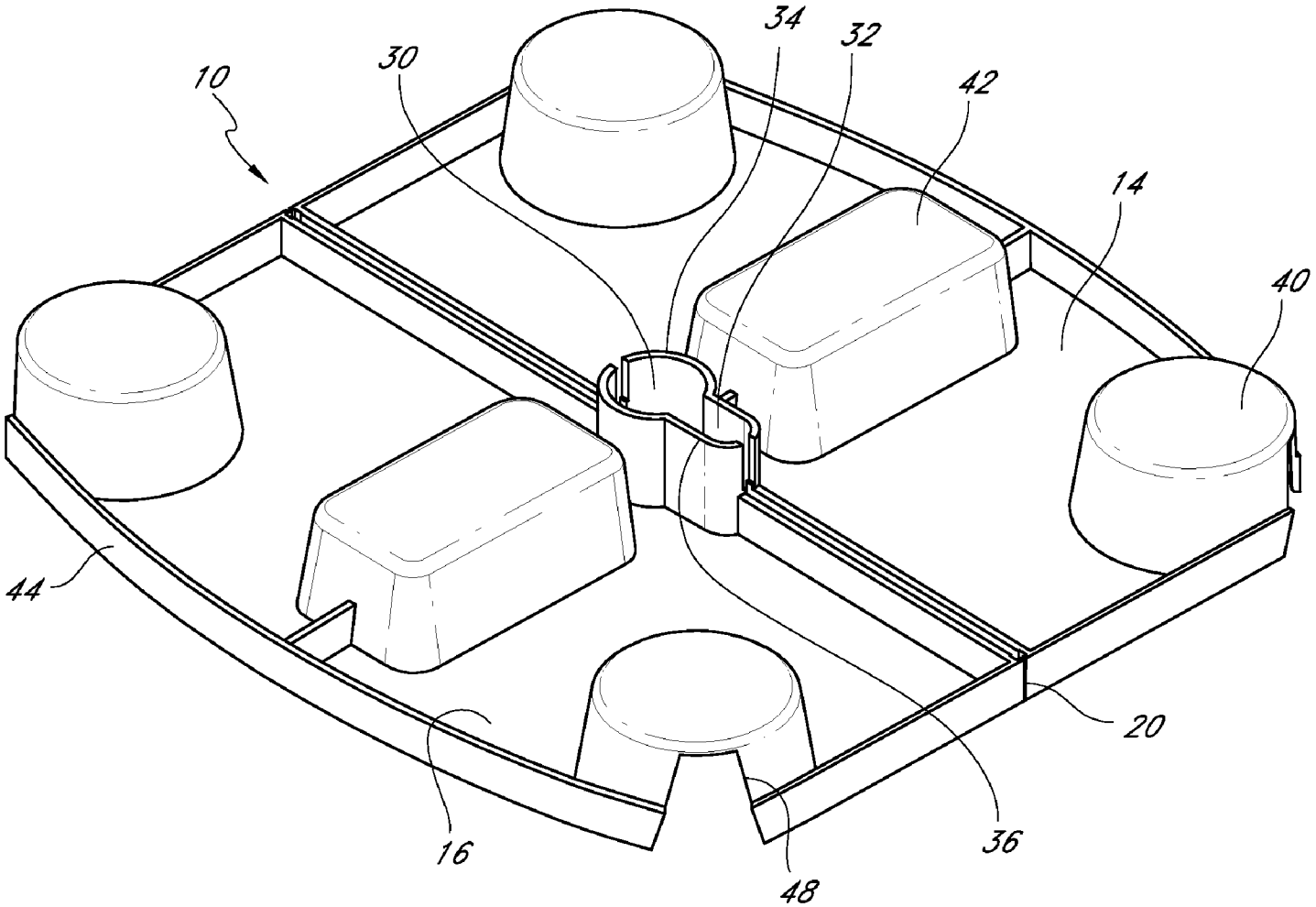
FIG. 2 is a bottom perspective view of the foldable table of FIG. 1.

The foldable table embodiments disclosed herein are well-suited for being supported by a pole such as the pole of a beach umbrella. However, the foldable table embodiments can be supported by any type of pole or similar rigid structure, and may find utility in a variety of other applications. The foldable tables are often described herein using relative terms, such as top, bottom, above, below, upper, lower, upward, downward, left and right. These terms are used for convenience and usually in the context of the specific figure (s) being described, unless otherwise noted or apparent from the context.

FIGS. 1-7 illustrate a foldable table 10 in an unfolded arrangement or position. The foldable table 10 includes a first table portion 14 and a second table portion 16. Preferably, the table portions 14 and 16 are rigid and generally flat. The first table portion 14 is coupled to the second table portion 16 at a joint or a hinge 20. Preferably, the first table portion 14 can rotate with respect to the second table portion 16 about the joint 20. As illustrated, the joint 20 defines an axis about which the first table portion 14 and the second table portion 16 can rotate or pivot.

Figure 3:
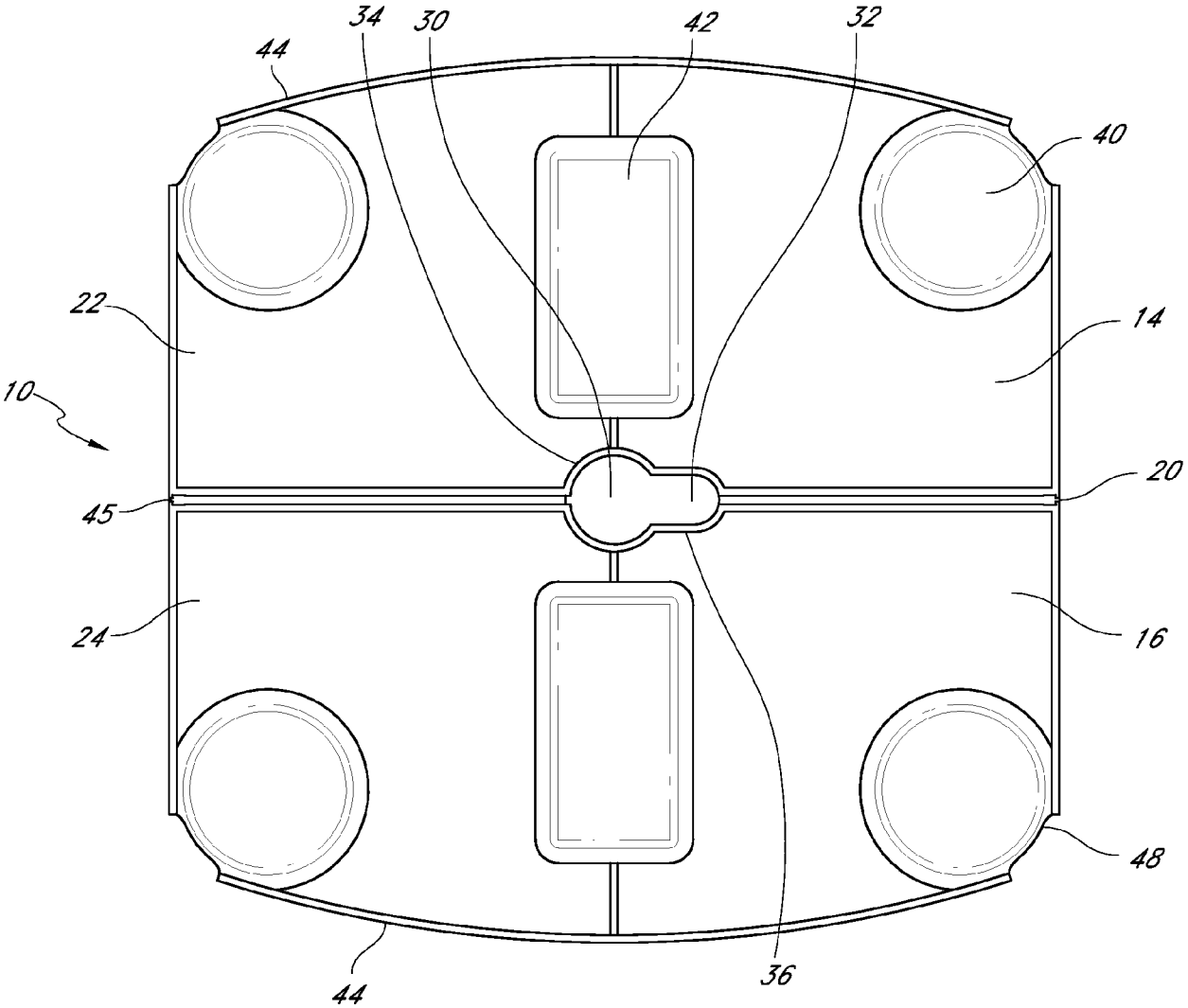
FIG. 3 is bottom view of the foldable table of FIG. 1.
Figure 4:
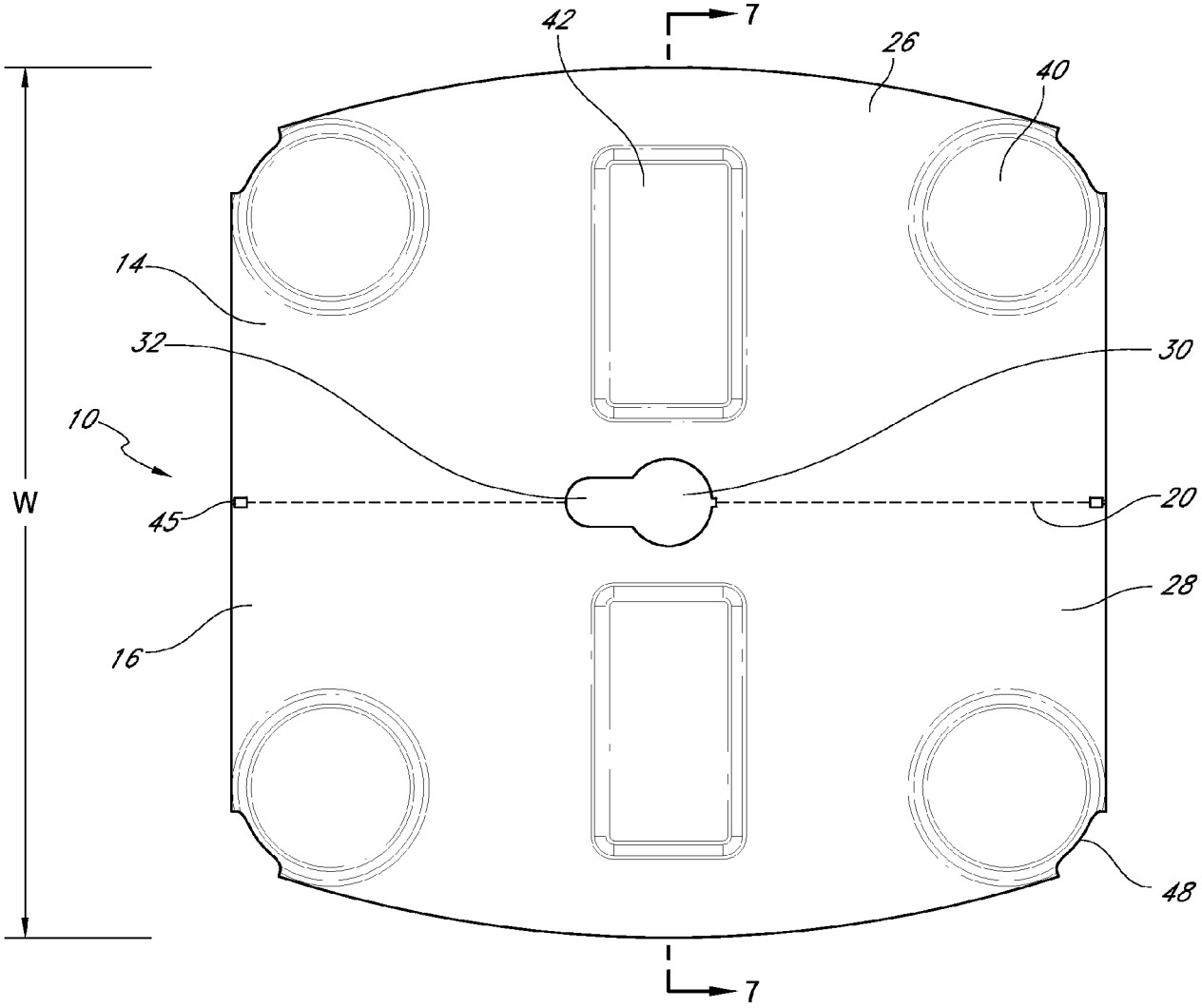
FIG. 4 is top view of the foldable table of FIG. 1.
Figure 5:
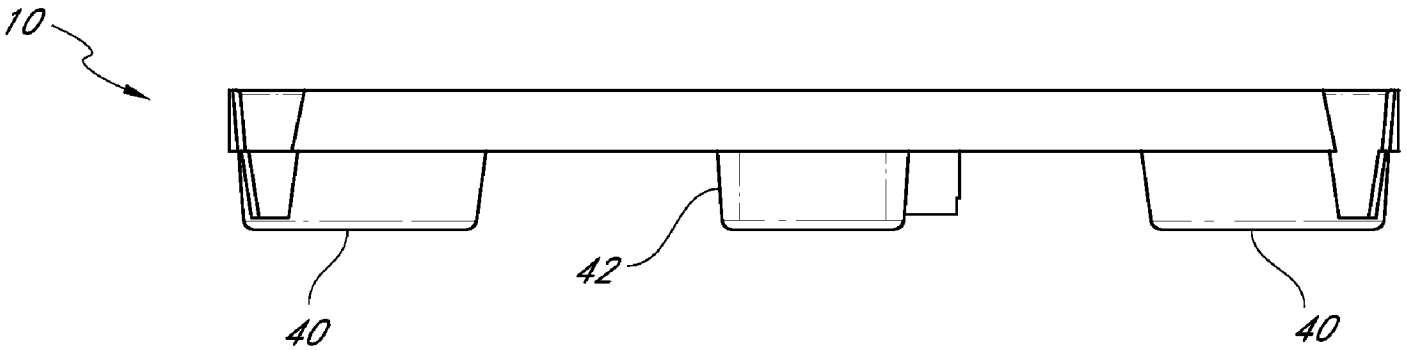
FIG. 5 is a side view of the foldable table of FIG. 1.
Figure 6:
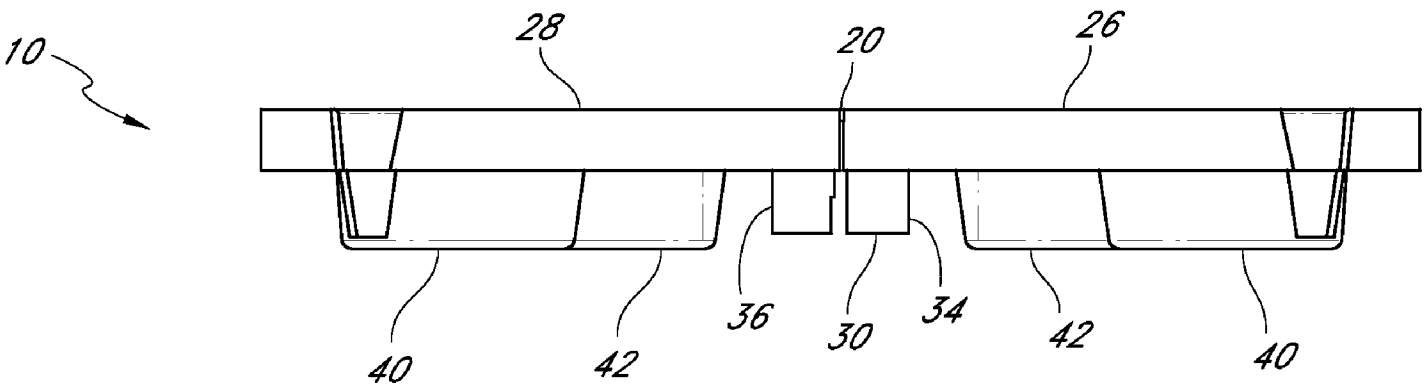
FIG. 6 is a front view of the foldable table of FIG. 1.

FIG. 3 illustrates the bottom of the foldable table 10 in the unfolded position. The first table portion 14 includes a bottom surface 22 and the second table portion 16 includes a bottom surface 24. FIG. 4 illustrates the top of the foldable table 10 in the unfolded position. The first table portion 14 includes a top surface 26 and the second table portion 16 also includes a top surface 28. In the unfolded positioning, the top surfaces 26 and 28 of the first and second table portions face upward in substantially the same direction. In a preferred embodiment, the first table portion 14 and the second table portion 16 are unitary or integral. Similarly, in one preferred embodiment, the joint 20 includes a flexible portion 21 connecting the table portions 14 and 16, and the table portions 14 and 16 and the flexible portion 21 are unitary or integral.

Preferably, the table 10 has a width W in the range between five inches and thirty inches. It is more preferable that the table have a width W of between ten and twenty inches. The foldable table 10 can be folded so that the overall width is reduced by several inches, and preferably reduced by half. By folding the table 10 and reducing the overall size, the table 10 is more easily transported and capable of being stored in smaller areas.

The foldable table 10 also includes a recess or opening 30. Preferably, the recess 30 is sized and shaped to receive a pole. In the preferred embodiment, the recess 30 is cylindrical, having a diameter and configured to receive a cylindrical pole. However, in some embodiments the recess 30 can be rectangular or can have other sizes or shapes. As illustrated, the recess 30 is defined by a first recess flange 34 and a second recess flange 36. Preferably, the first recess flange 34 is supported by the first table portion 14 and the second recess flange 36 is supported by the second table portion 16. In the unfolded positioning, the first recess flange 34 and the second recess flange 36 cooperate to define the recess 30.

The first recess 30 is located between the first and second table portions 14 and 16. Preferably, the first recess 30 also extends through the axis of the joint 20. In other preferred embodiments, the first recess 30 is located away from the joint 20 and on one of the first and second table portions. The first recess 30 can also be positioned at or near one of the ends of the joint 20 or proximate the edge of the table 10.

In one preferred embodiment, the table 10 also includes a second recess 32 that is at least partially cylindrical and is smaller than that of the first recess 30. The second recess 32 is preferably adjacent the first recess 30 and is also defined by the first recess flange 34 and the second recess flange 36. Preferably, the second recess 32 is sized and shaped to receive poles having smaller diameters than those received by the first recess 30. Thus, the different sized recesses 30 and 32 allow the table 10 to be securely supported by poles of various sizes. In other preferred embodiments, the second recess 32 is positioned away from the first recess 30 at a location on the joint 20 or is disposed on one of the table portions. The table 10 can also include more than two recesses each having a different size in order to receive poles of various sizes.

The first and second table portions 14 and 16 preferably include storage features such as receptacles 40 that are round and configured to hold beverages or similarly shaped items. The table portions 14 and 16 also include rectangular receptacles 42. In the illustrated arrangement, the table portions 14 and 16 are symmetrical and the overall shape of table 10 is substantially rectangular. However, in other embodiments the overall shape of the table is circular, or alternatively the table can have an asymmetric shape. Similarly, the joint 20 extends along the center of the table 10, but in other embodiments the joint can be located off-center and the table portions can be asymmetrical. In other embodiments, the table includes more than two table portions that are rotatably coupled and foldable.

As illustrated, the first table portion 14 and second table portion 16 each have an outer flange 44 extending along portions of the outer edge of each table portion. The outer flange 44 can improve the aesthetic of the table 10 and can also make it easier to fold and carry the table 10. Preferably, the outer flanges 44 of the table portions 14 and 16 include contact portions 45 arranged to contact each other when the table 10 is in the unfolded position. As illustrated, the flange contact portions 45 are adjacent the ends of the joint 20. The contact portions 45 can be protrusions or other features extending from the flanges 44. Preferably, the contact portions 45 are arranged to contact one another and inhibit rotation of the table portions 14 and 16 substantially beyond the illustrated unfolded position. In other preferred embodiments, the entire flange portions between the table portions 14 and 16 can be arranged as contact portions that contact each other to prevent rotation beyond the unfolded position.

The round receptacles 40 preferably include cut-out portions 48 that allow water or other liquid to flow out of the round receptacles 40. Preferably, the table portions 14 and 16 comprise a durable and rigid plastic or polymer material that is lightweight, making the table 10 lightweight for easy transporting but also durable and easy to maintain. The foldable table 10 and the table portions 14 and 16 are preferably manufactured in a molding process or extrusion process. In a preferred embodiment, the table 10 is molded as a single piece of plastic material.

Figure 7:
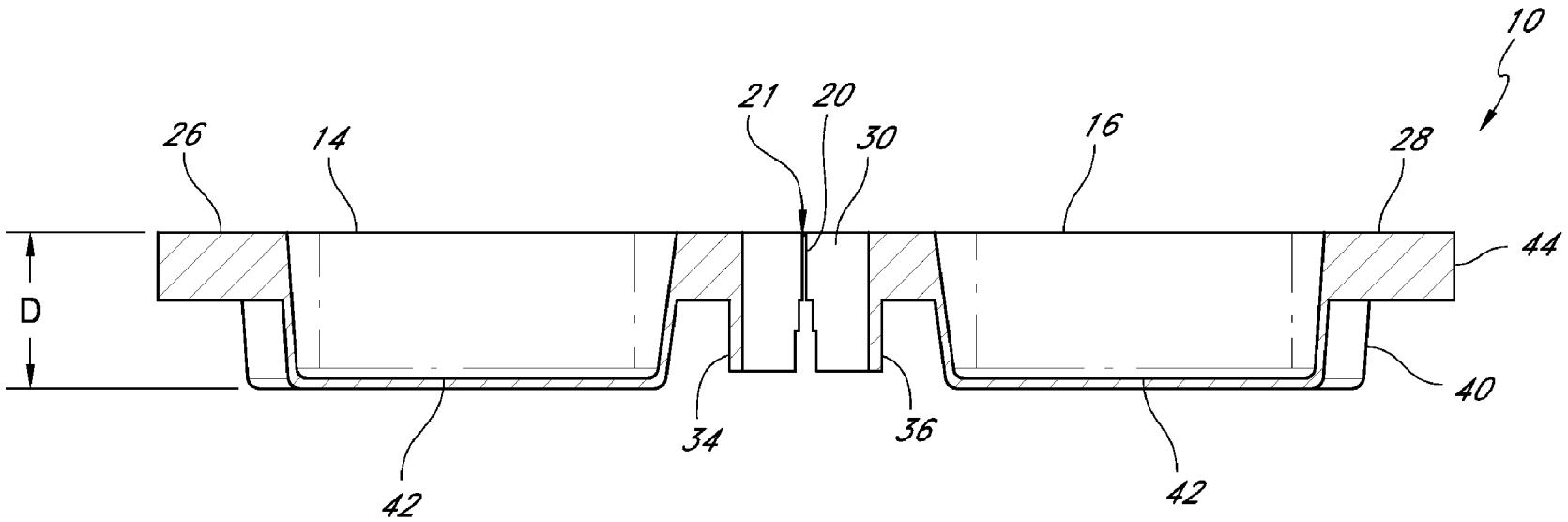
FIG. 7 is a cross-sectional view of the foldable table of FIG. 1 taken along line 7-7 of FIG. 4.

As illustrated in FIG. 7, the first table portion 14 and the second table portion 16 are preferably coupled at the joint 20. The overall thickness or depth D of the foldable table 10 is preferably less than five inches. In a preferred embodiment, the overall depth D of the table 10 is less than two inches.

Preferably, the table portions 14 and 16 are coupled by a thin piece of material 21 at the joint 20. The piece of material 21 is flexible and resilient so that there can be repeated relative rotation and folding of the table portions 14 and 16. Preferably, the piece of material 21 extends from the first top surface 26 to the second top surface 28 and couples the first top surface 26 to the second top surface 28. In some embodiments, the material is a plastic or polymer material with elastic characteristics.

In other preferred embodiments, the joint 20 includes a pin, hook, swivel, barrel hinge, pivot hinge, concealed hinge, or any other type of hinge. Any type of hinge or pivot mechanism capable of rotatably coupling the two table portions 14 and 16 can be used at the joint 20 to couple the table portions. The first table portion 14 and the second table portion 16 can also be removably coupled using a disconnecting hinge.

Figure 8:
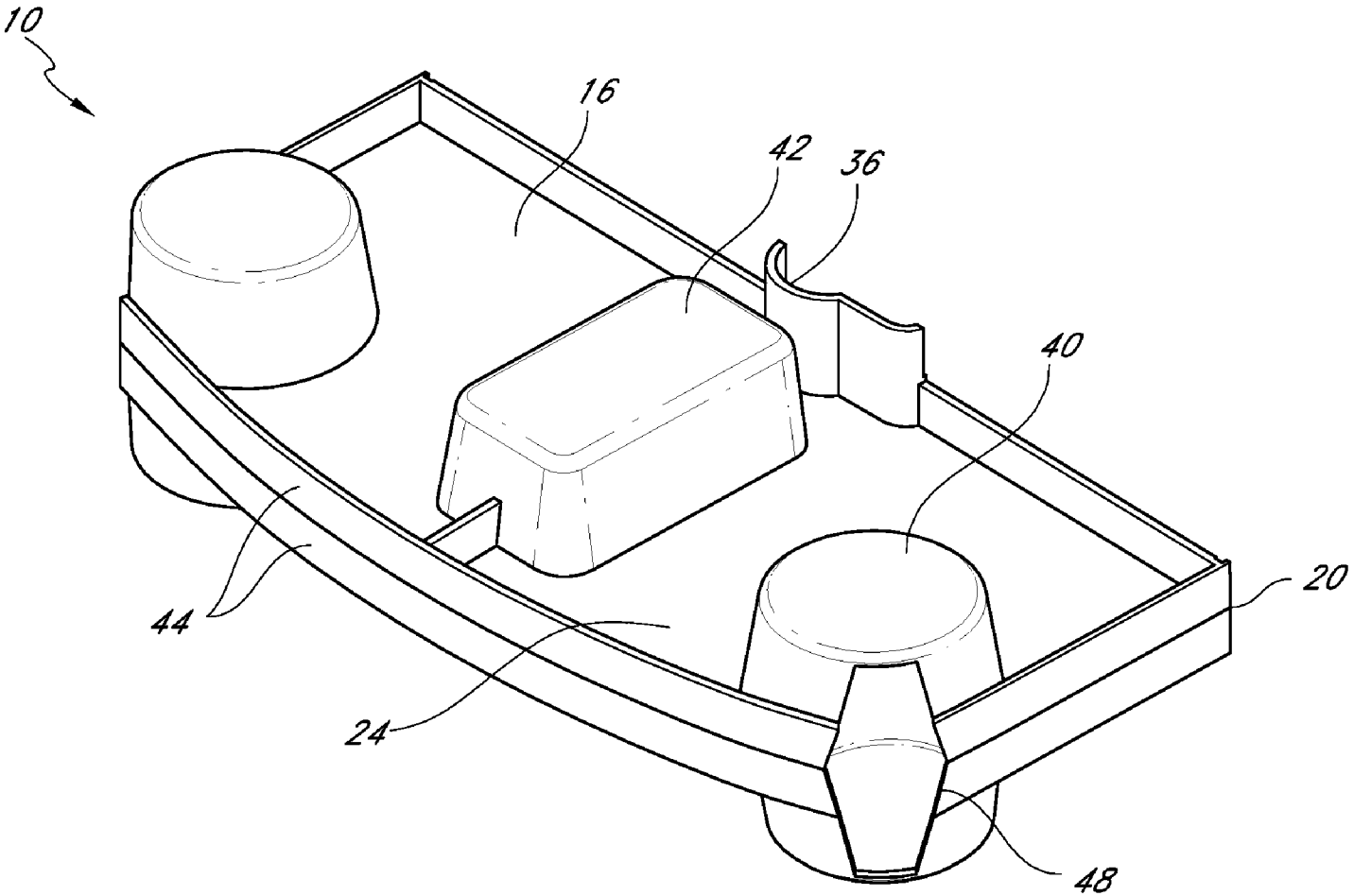
FIG. 8 is perspective view of the foldable table of FIG. 1 illustrating the foldable table in a folded arrangement.

FIG. 8 illustrates the foldable table 10 in a folded arrangement. Preferably, the foldable table 10 is folded by rotating one or both of the table portions 14 and 16 about the joint 20 so that the top surfaces 26 and 28 move toward one another. One of the table portions 14 or 16 rotates about the joint 20 and 180° with respect to the other table portion so that the first top surface 26 faces the second top surface 28, as illustrated. Therefore, when the table 10 is in the unfolded arrangement, the top surfaces 26 and 28 face upward in substantially the same direction, and when the table 10 is folded about the joint 20, the top surfaces 26 and 28 face in opposite directions and face one another. In an alternate embodiment, the foldable table is folded by folding the table portions 14 and 16 around the joint 20 so that the top surfaces 26 and 28 face away from each other and the bottom surfaces 22 and 24 face each other.

Preferably, when the foldable table 10 is in the folded arrangement, the first top surface 26 contacts the second top surface 28 and the table 10 is reduced in overall size compared to the unfolded arrangement. It is also preferred that the outer flange 44 and receptacles 40 and 42 are relatively shallow so that the overall thickness of the folded table 10 is minimized. With a minimal folded thickness, the table 10 is easier to transport and is also lighter as it requires less material. Folding the table 10 can significantly reduce the overall width of the table 10 and make it easier for a person to transport or store.

Figure 10:
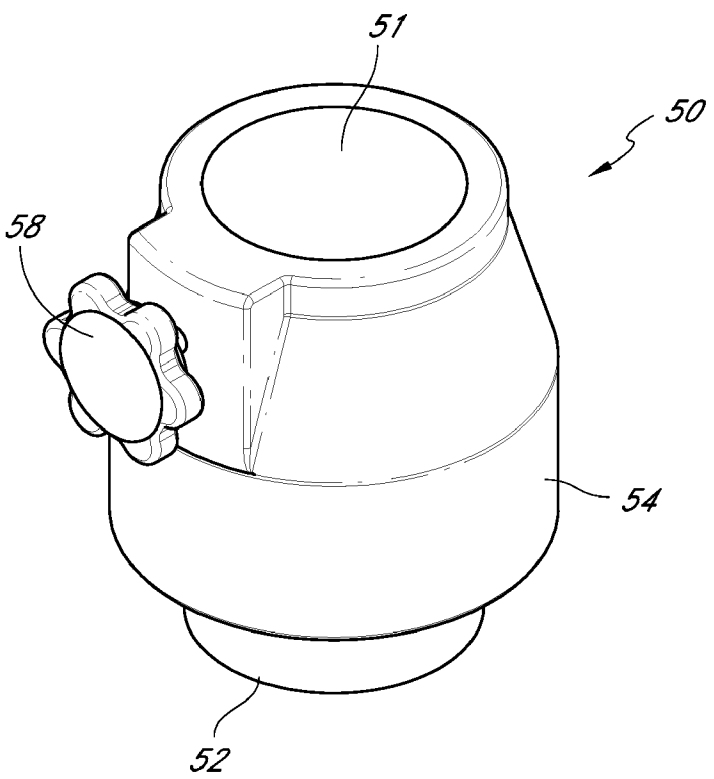
FIG. 10 is another perspective view of the support member of FIG. 9.
Figure 9:
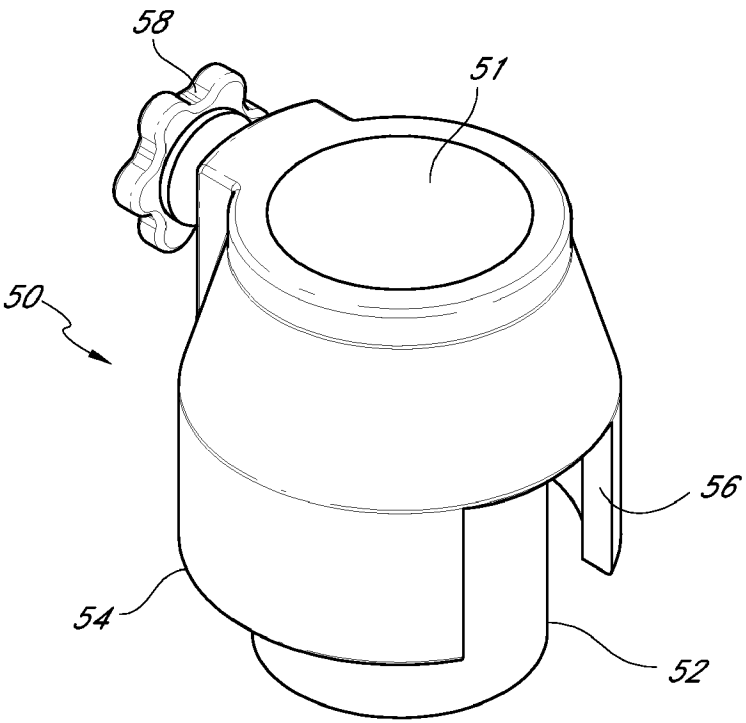
FIG. 9 is a perspective view of an embodiment of a foldable table support member.

FIGS. 9 and 10 illustrate a foldable table support member 50 having an opening 51. The opening 51 extends through the support member 50. The support member 50 also includes an inner portion 52 and an outer portion 54. Preferably, the inner portion 52 and the outer portion 54 are cylindrical and concentric. The outer portion includes a cut-out portion 56. The support member 50 also includes a securing member 58. Preferably, the securing member 58 is arranged to engage a pole when the pole is received into the opening 51. The securing member 58 applies a pressure to the pole and frictionally engages the pole to secure the support member 50 at a position along the pole. As illustrated, the securing member 58 includes a screw portion so that rotating the securing member 50 moves a portion of the securing member 50 into the opening 56 to engage a pole.

Figure 11:
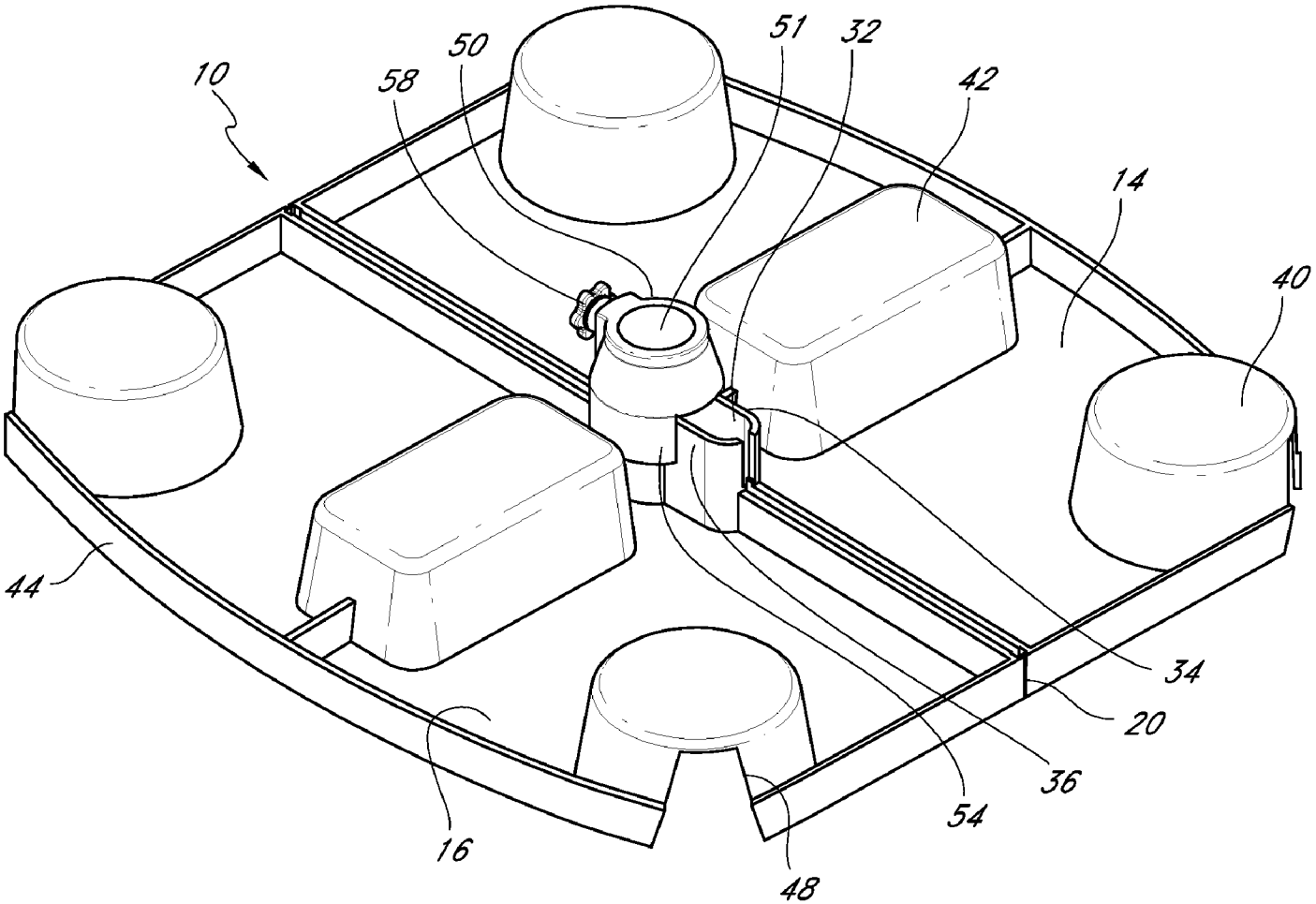
FIG. 11 is a perspective view of the support member of FIG. 9 engaging the foldable table of FIG. 1.

FIG. 11 illustrates the support member 50 coupled to the foldable table 10 of FIG. 1. The support member 50 is coupled to the table 10 adjacent the first recess 30. Preferably, the inner portion 52 extends into the first recess 30 and the opening 51 is concentric with the first opening 30. The support member 50 engages both table portions 14 and 16. Preferably, the outer portion 54 engages the first recess flange 34 and the second recess flange 36 so that when the support member 50 is coupled to the table 10 it inhibits rotation of the table portions 14 and 16 about the joint 20. Preferably, the support member 50 is coupled to the bottom of the table 10 so that the support member 50 supports the table when a pole is received through the first recess 30 and the opening 51. As illustrated, the inner portion 52 and the outer portion 54 are preferably sized and shaped so that the support member can support the table 10 without additional parts. Similarly, the inner portion 52 and the outer portion 54 are preferably sized and shaped so that, when the support member 50 is supporting the table 10, the support member 50 is inhibited from moving horizontally with respect to the table portions 14 and 16. Preferably, the table 10 and the support member 50 are the only items necessary for coupling the table 10 to a pole and using the table. Therefore, there are not numerous parts and elements and need to be assembled, transported or carefully stored. Therefore, it is easy and convenient to unfold the table and arrange the support member 50 and table 10 on a pole.

Different sized support members can be used with the table, depending on the size of the pole. In other preferred embodiments, the support member is smaller and shaped to be coupled to the table 10 at the second recess 32. A smaller inner portion of the support member enters the second recess 32 and a smaller version of the outer portion 54 engages the first recess flange 34 and the second recess flange 36 so that the smaller support member inhibits rotation of the table portions 14 and 16 about the joint 20. In other embodiments, larger or smaller support members can support the table 10, depending on the size of the recesses of the table and the size of the pole.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present chair adjustment mechanism has been described in the context of particularly preferred embodiments, the skilled artisan will appreciate, in view of the present disclosure, that certain advantages, features and aspects of the adjustment mechanism may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A portable table comprising:

a first table portion;

a second table portion, the second table portion being rotatably coupled to the first table portion;

a joint between the first table portion and the second table portion, the joint including a flexible portion that is unitary with the first and second table portions, the first and second table portions each being rotatable about the joint;

a first recess adjacent the joint and configured to receive a pole;

wherein the first table portion is rotatable with respect to the second table portion so that the table can be folded by rotating the first table portion toward the second table portion wherein the first table portion and second table portion have respective first and second outer flanges extending along an outer edge of each table portion, and each of the first and second outer flanges includes a contact portion, the contact portion of the first outer flange contacts the contact portion of the second outer flange in an unfolded position to inhibit relative rotation of the first and second table portions beyond the unfolded position.

2. The portable table of claim 1, further comprising a support member, the support member being configured to engage the first recess and frictionally engage a pole.

3. The portable table of claim 2, wherein the support member is configured to engage the first and second table portions such that the support member inhibits relative rotational movement between the first and second table portions.

4. The portable table of claim 3, wherein the first and second table portions each include a recess flange and the support member is configured to engage the recess flange of each of the table portions.

5. The portable table of claim 1, wherein the first recess is located between the first table portion and the second table portion, the first recess extending through a portion of the joint.

6. A portable table comprising:

a first table portion having a first surface that is generally planar;

a second table portion having a second surface that is generally planar, the second table portion rotatably coupled to the first table portion;

a first recess configured to receive a pole or rigid structure;

a support member configured to engage both the first and second table portions;

wherein the first and second table portions have a first position in which the first surface and the second surface face in substantially the same direction;

wherein the first and second table portions have a second position achieved by rotating at least one of the first and second table portions so that the first surface and the second surface face in opposite directions;

wherein the first table portion includes a first flange and the second table portion includes a second flange, the first flange including a first flange portion adjacent the first recess, the second flange including a second flange portion adjacent the first recess, the support member engages the first flange portion of the first flange and the second flange portion of the second flange to inhibit movement of the first and second flange portions away from each other and relative rotational movement between the first and second table portions when the first and second table portions are in the first position.

7. The portable table of claim 6, wherein the first surface and the second surface are substantially parallel and face each other when the first and second table portions are in the second position.

8. The portable table of claim 6, wherein the first surface and the second surface are rotatably coupled by a flexible material.

9. The portable table of claim 8, wherein the first surface and second surface are integral with the flexible material.

10. The portable table of claim 6, wherein the first recess extends perpendicular to the first and second surfaces when the first and second table portions are in the first position.

11. The portable table of claim 6, wherein the first table portion and the second table portion are unitary or integral.

12. The portable table of claim 6, wherein each of the first and second flanges comprises a contact portion configured to inhibit rotation of the table portions substantially beyond the first position.

13. The portable table of claim 6, wherein the first flange extends downward from the first surface, and the second flange extends downward from the second surface.

14. The portable table of claim 13, wherein the first recess and a second recess are defined by the first and second flanges.

15. The portable table of claim 14, wherein the support member comprises a groove defined between an inner portion and an outer portion.

16. The portable table of claim 15, wherein the support member engages the first flange portion and the second flange portion adjacent the first recess, the first recess being within the outer portion of the support member and the second recess extending outside of the outer portion of the support member, and the support member comprising an opening through which respective portions of the first flange and the second flange that define the second recess pass.

* * * * *